US006421847B2

(12) United States Patent
Berke et al.

(10) Patent No.: US 6,421,847 B2
(45) **Date of Patent: *Jul. 23, 2002**

(54) HOUSEHOLD LIQUID DISPENSING SYSTEM

(75) Inventors: Joseph J. Berke, 3248 Interlaken, West Bloomfield, MI (US) 48323; Charles T. Michael, Troy, MI (US)

(73) Assignee: Joseph J. Berke, West Bloomfield, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/344,992

(22) Filed: Jun. 25, 1999

(51) Int. Cl.[7] ..... A47K 3/28; B05B 7/30
(52) U.S. Cl. ..... 4/615; 4/903; 239/318
(58) Field of Search ..... 4/903, 605, 615, 4/675; 239/318, 314, 302, 307; 222/147.5; 141/348

(56) References Cited

U.S. PATENT DOCUMENTS 3,231,200 A * 1/1966 Heald ..... 4/605 X
3,333,601 A * 8/1967 Lofgreen ..... 239/318 X
3,720,352 A * 3/1973 Kozlowski ..... 222/132
4,218,013 A * 8/1980 Davison ..... 4/903 X
4,295,612 A * 10/1981 Betsinger et al. ..... 239/310
4,358,056 A * 11/1982 Greenhut et al. ..... 4/903 X
4,840,311 A * 6/1989 Shamblin ..... 239/307 X
4,901,765 A * 2/1990 Poe ..... 137/893
5,071,070 A * 12/1991 Hardy ..... 239/318 X
5,174,503 A * 12/1992 Gasaway ..... 239/307

* cited by examiner

*Primary Examiner*—Charles E. Phillips
(74) *Attorney, Agent, or Firm*—Alex Rhodes

(57) ABSTRACT

A household liquid dispensing system for dispensing a household liquid, such as soap, shampoo, dish washing detergent and bath oil through an outlet of a household water system. The liquid dispensing system comprises a household water system having an outlet, a storage unit for storing at least one liquid operatively connected to the household water system, and a control for connecting and disconnecting the storage unit to the household water system. In a first aspect of the invention the liquid is introduced into the household water system by a venturi. In a second aspect of the invention, the storage unit is positioned above an outlet of the household water system and is introduced by gravity. The control is normally biased to an "off" position. This invention can be utilized for showers, bathtubs, laundry tubs and sinks.

11 Claims, 11 Drawing Sheets

HOUSEHOLD LIQUID DISPENSING SYSTEM

FIELD OF THE INVENTION

This invention relates to liquid dispensing and more particularly to a storage unit operatively connected to a household water system.

BACKGROUND OF THE INVENTION

Currently, liquid household products such as soap, shampoo, bath oil and dishwashing detergent are applied in full strength and thereafter diluted and rinsed with water. One drawback of the current practice is that household products are often stored at random locations, and difficult to find. The products are not well organized with containers and bottles not easily accessible or littered in disarray on the floor. currently much space is wasted. Another drawback is that the use of household products varies greatly among individuals. Another drawback is that they are difficult to apply uniformly. Another drawback is that the current practice is wasteful with regard to the use of household products and water.

SUMMARY OF THE INVENTION

The present invention provides a number of advantages over the current practice. One advantage is that liquid household products are stored at single locations; available for immediate use. A second advantage is the convenience and utility of discharging household products through household water system outlets. By way of illustration, the utility of laundry tubs is substantially increased by discharging liquid soap through water outlets of laundry tubs during the bathing of pets, cleaning of paint brushes, washing of hands, and dying of hair. A third advantage is a savings with more efficient use of household products. A fourth advantage is an ability to uniformly apply liquid household products. A fifth advantage is an ability to automatically mix solutions of household products and water. A sixth advantage is less spillage and less accidents due to slipping and sliding.

The invention broadly comprises a storage unit for storing liquid household products, connected to a household water system, such as a bathtub, shower, laundry tub and kitchen sink and a control for operatively connecting and disconnecting the storage unit from the household water system. one feature of the invention is that the concentrations of the household products in the water solutions can be selectively controlled. Controlled amounts of the household products are introduced into the household water systems, mixed with water and discharged through outlets such as spray heads. The control between the storage unit and household water system selects the liquid and amount to be dispensed. The control is normally biased to an. "off" position to prevent inadvertent discharges of the household products. In a first aspect of the invention, the liquid household products are introduced into the household water system by a venturi. In a second aspect, the storage unit is positioned above an outlet of the household water system and the household products are introduced into the household water system by gravity feed.

In employing the teaching of the present invention, a plurality of alternate constructions can be adopted to achieve the desired results and capabilities. In this disclosure, some alternate constructions are discussed. However, these embodiments are intended as examples, and should not be considered as limiting.

Further objects, benefits and features of the invention will become apparent from the ensuing detailed description and drawings which illustrate and describe the invention. The best mode which is contemplated in practicing the invention together with the manner of using the invention are disclosed and the property in which exclusive rights are claimed is set forth in each of a series of numbered claims at the conclusion of the detailed description.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DESCRIPTION OF THE PREFERRED EMBODIMENT

Figure 2:
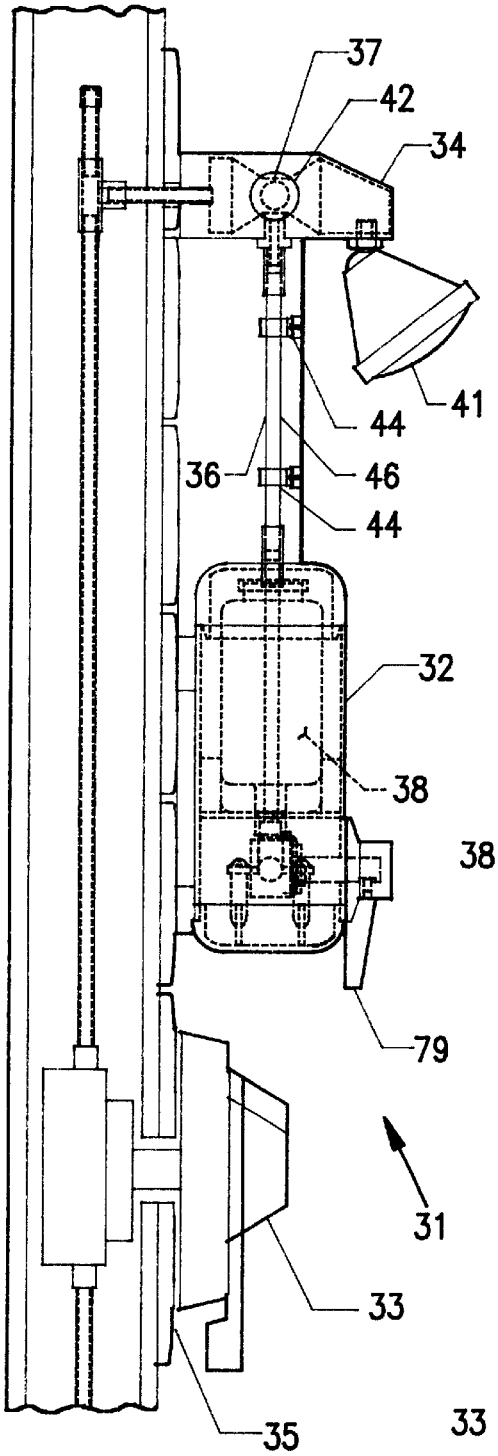
FIG. 2 is a right side view of FIG. 1.

Referring now to the drawings wherein like numerals designate similar and corresponding parts throughout the several views, a first aspect of a household liquid dispensing system 31 is illustrated in FIGS. 1, 2 and 9–19 which comprises a storage unit 32 operatively connected to a household water system 33. The household water system 33 is a shower system 33. The shower system 33 dispenses water solutions of liquid household products, such as soap, shampoo, and bath oil through a shower head 34.

The storage unit 32 is mounted on a shower wall 35 below the shower head 34 and is connected to the shower head 34 by a tube 36. Inside of the shower head 34 is a venturi 37 which draws a portion of a household liquid 38 from the containers 39, 40 inside of the storage unit 32 into the shower head 34. The liquid 38 is mixed with water and discharged as a spray through an outlet 41 of the shower head 34. On a side of the shower head 34 is a needle valve 42 which is threadably movable into and out of the venturi 37. The needle valve 42 is used to adjust the amount of the household liquid 38 which is withdrawn from the storage unit 32. The tube 36 is covered by a thin decorative cover 48 which is attached to the tube with a pair of resilient spring clips 44.

Figure 4:
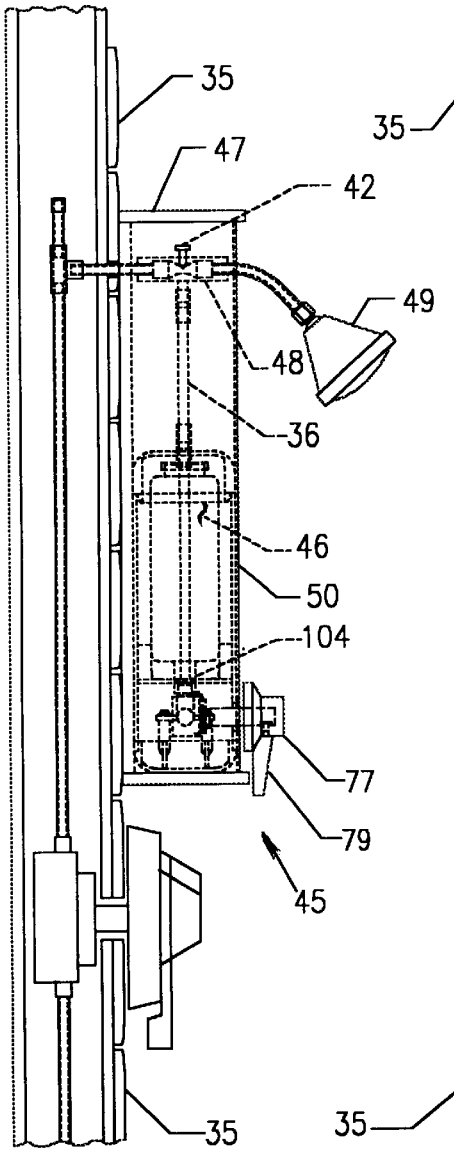
FIG. 4 is a right side view of FIG. 3.
Figure 3:
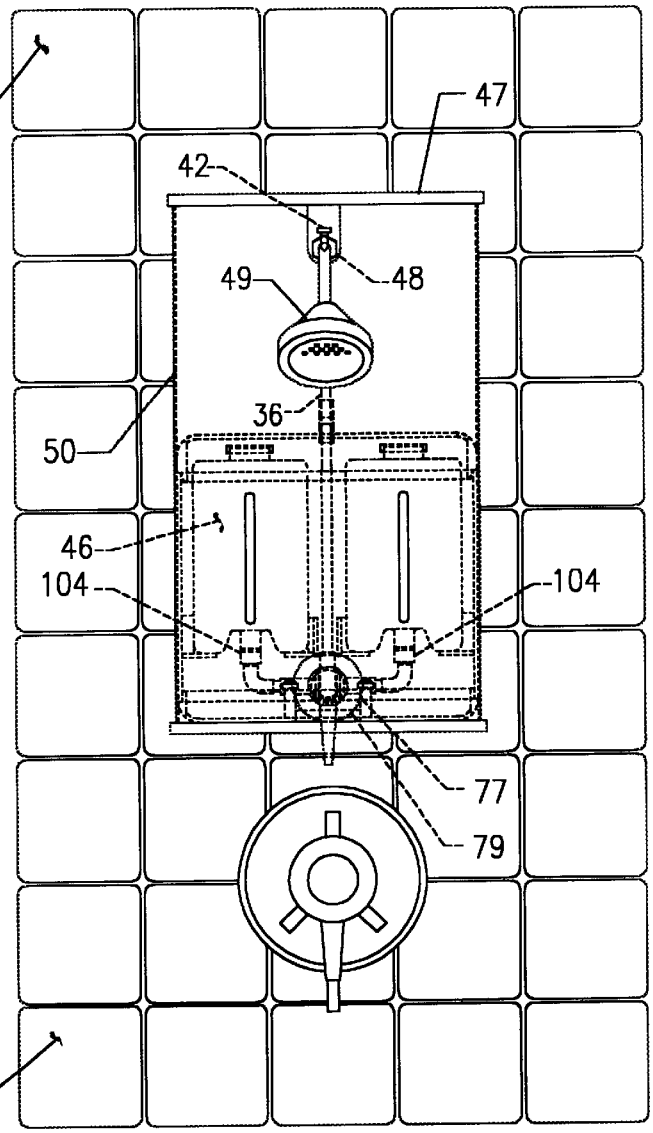
FIG. 3 is a front view of an alternate embodiment of the liquid household dispensing system.

In FIGS. 3 and 4, an alternate embodiment 45 is shown wherein a liquid storage unit 46 is mounted on a permanent "built-in" shelf 47 and connected to a separate venturi 48 which is ahead of a shower head 49. A thin removable cover 50 encloses the storage unit 46 and tube 36.

Figure 5:
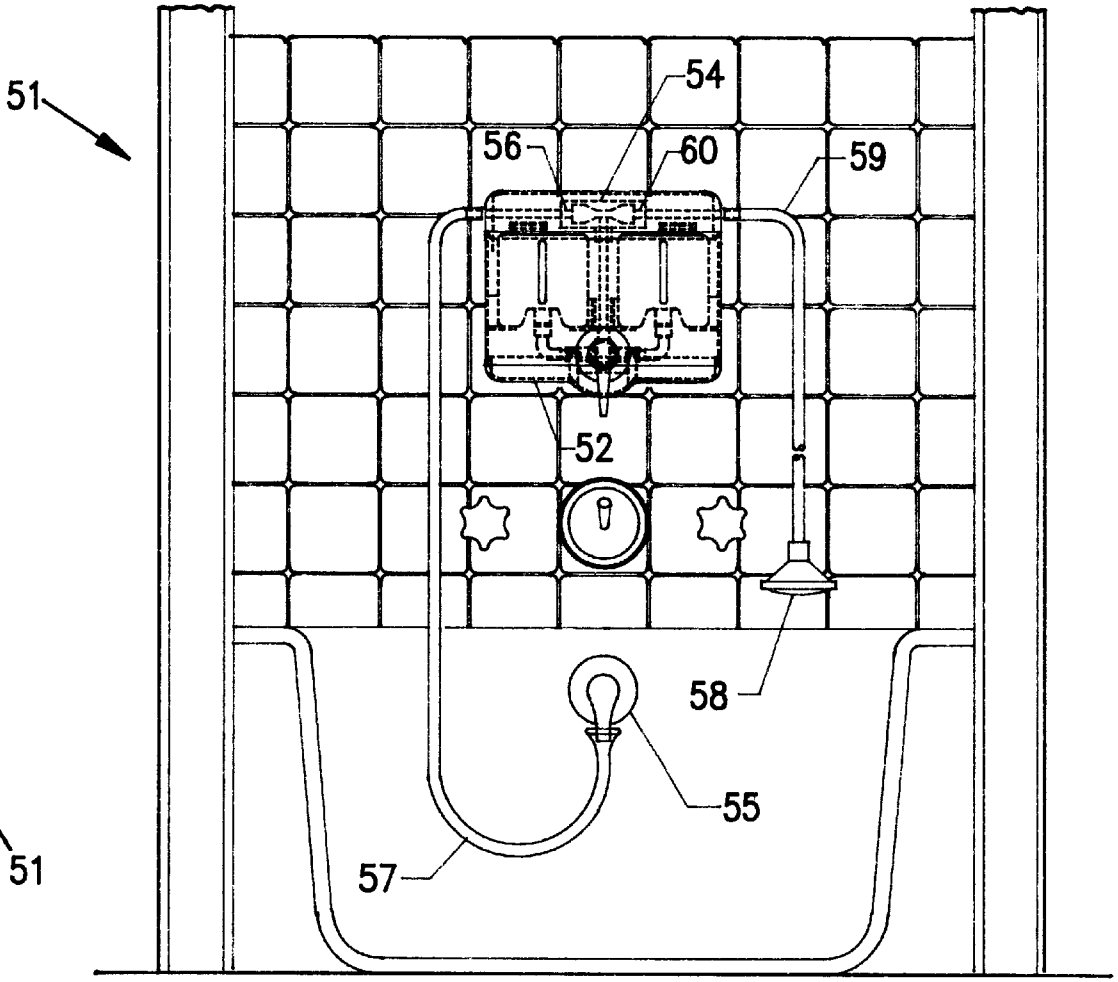
FIG. 5 is a front view of a second alternate embodiment of the liquid household dispensing system.
Figure 6:
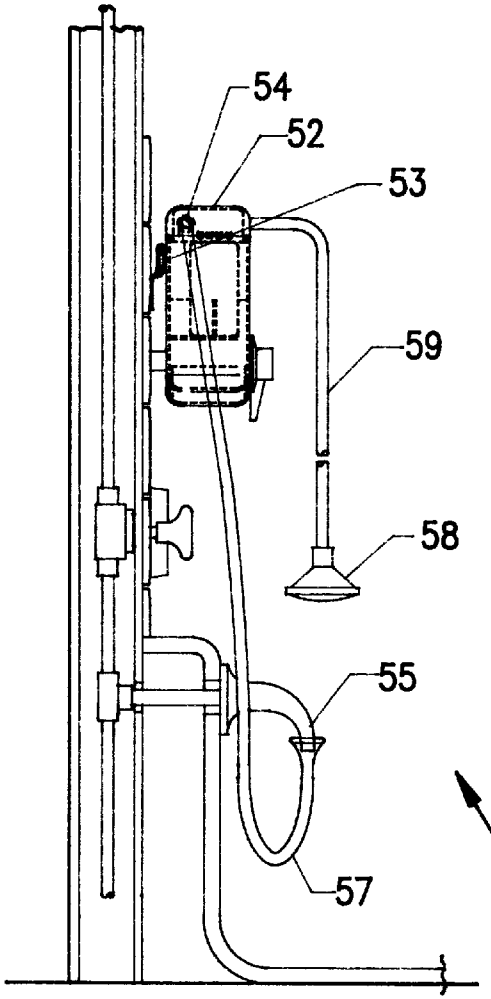
FIG. 6 is a right side view of FIG, 5.
Figure 7:
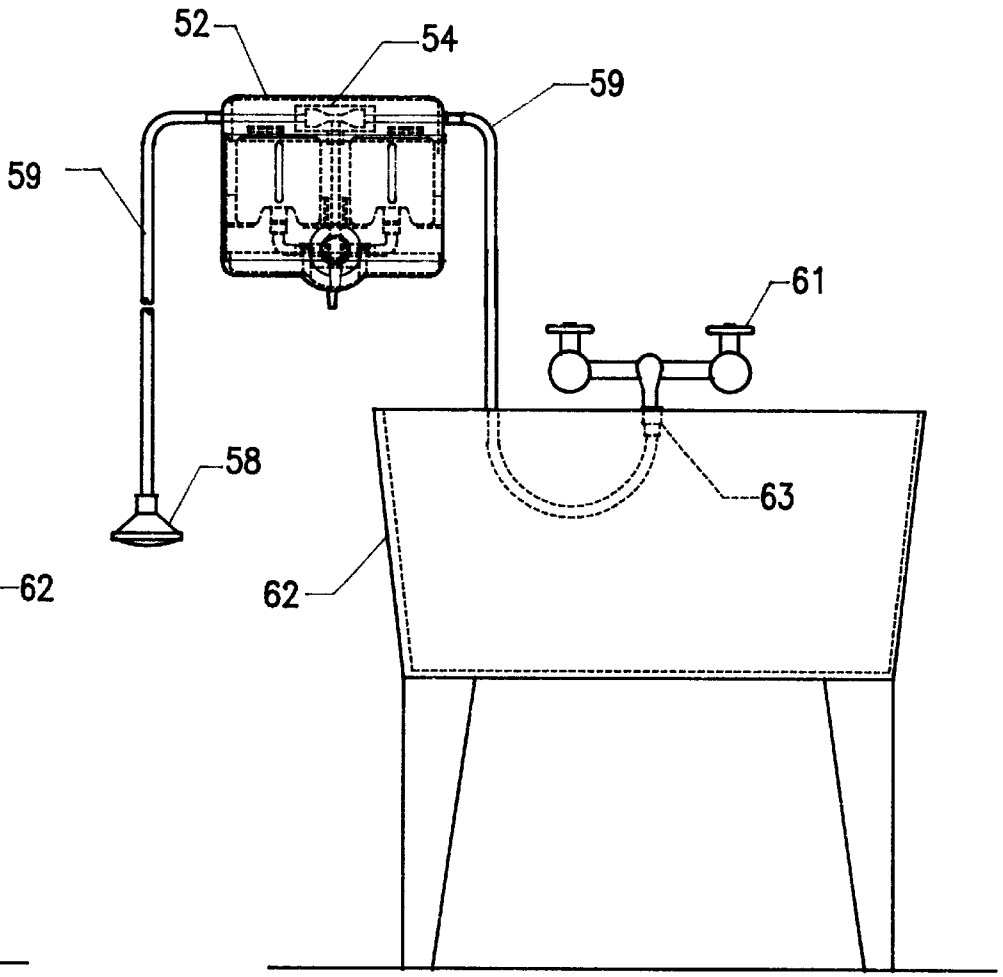
FIG. 7 is a front view of a third alternate embodiment of the liquid household dispensing system.
Figure 8:
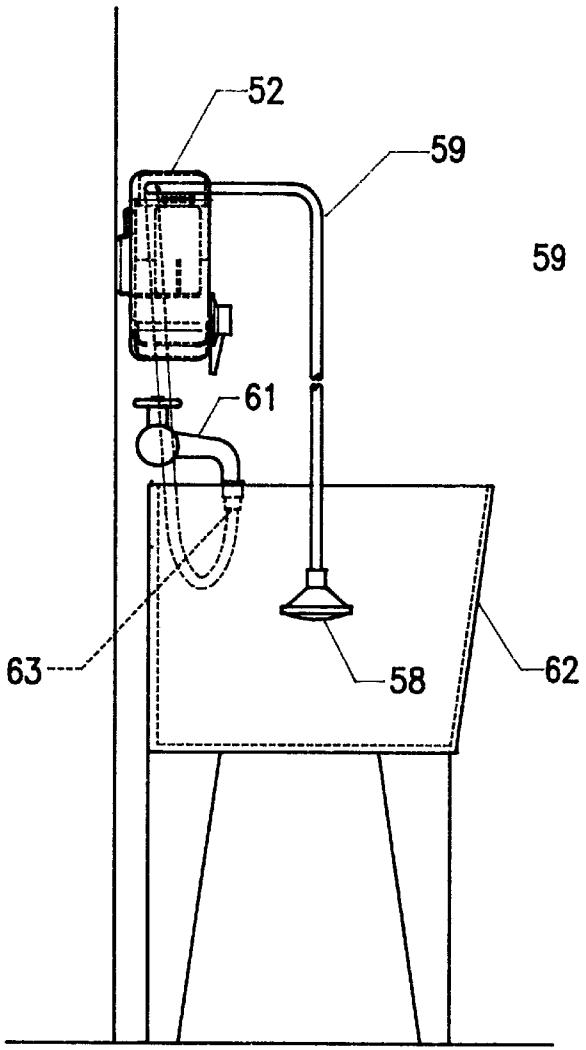
FIG. 8 is a right side view of FIG. 7.
Figure 9:
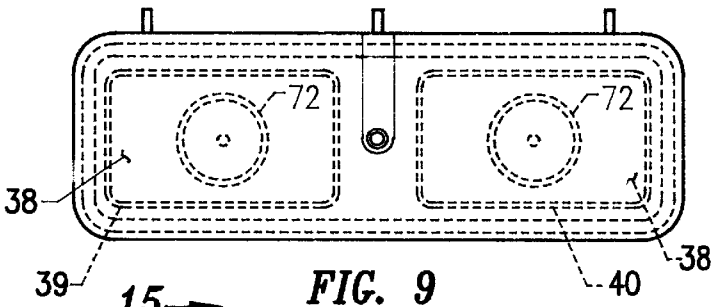
FIG. 9 is a plan view of a liquid storage unit shown in FIGS. 1 through 8.
Figure 10:
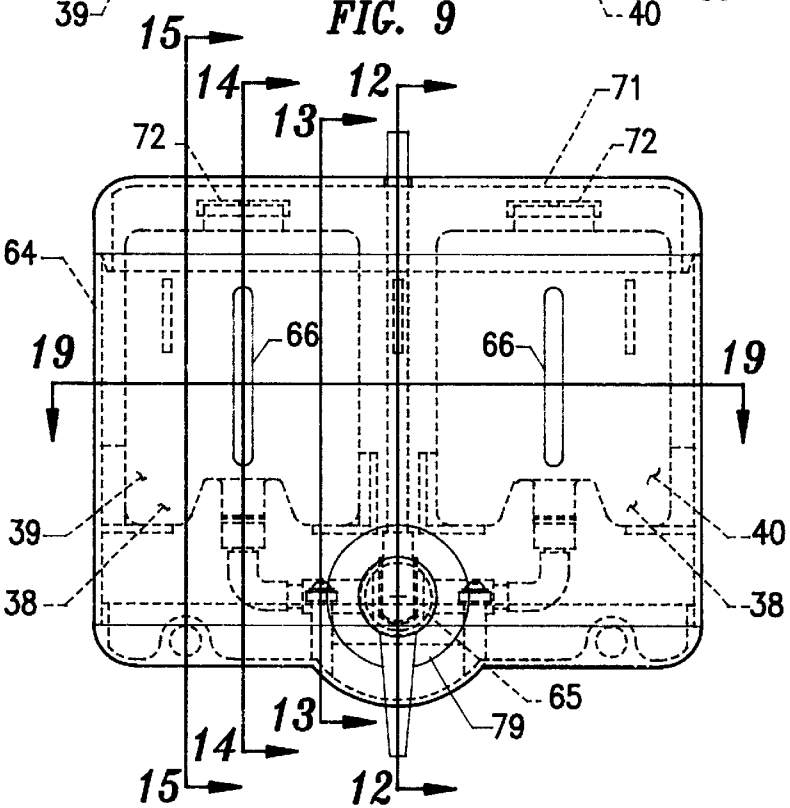
FIG. 10 is a front view of the liquid storage unit.
Figure 11:
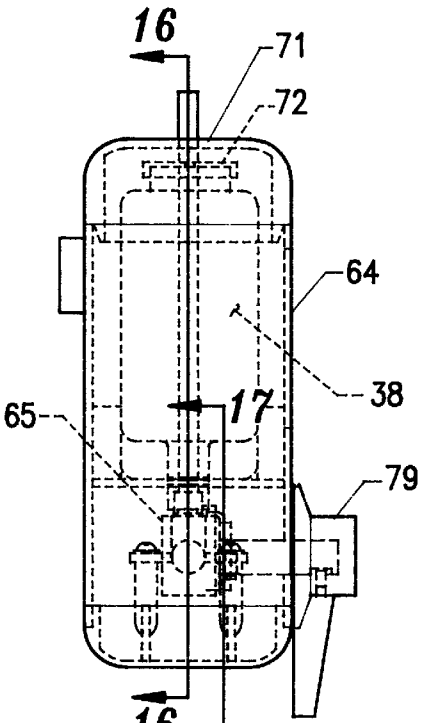
FIG. 11 is a right side view of the liquid storage unit.
Figure 13:
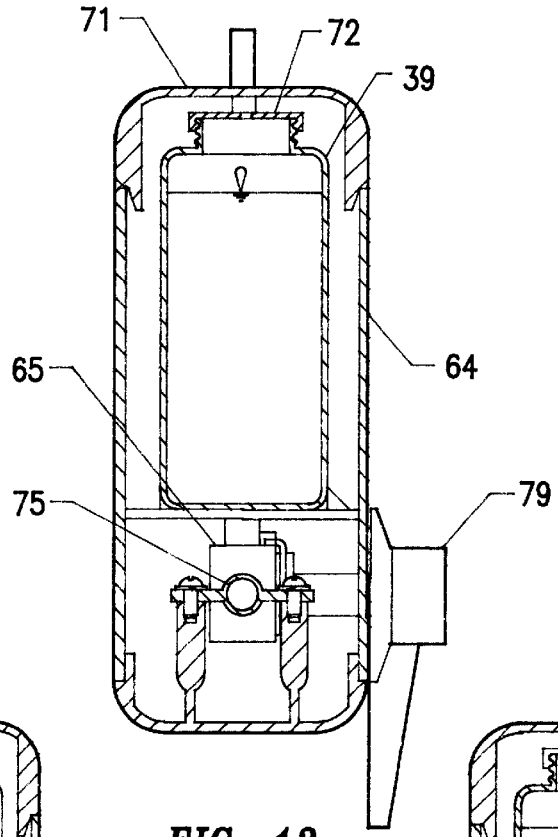
FIG. 13 is a cross-sectional view taken on the line 13—13 of FIG. 10.
Figure 12:
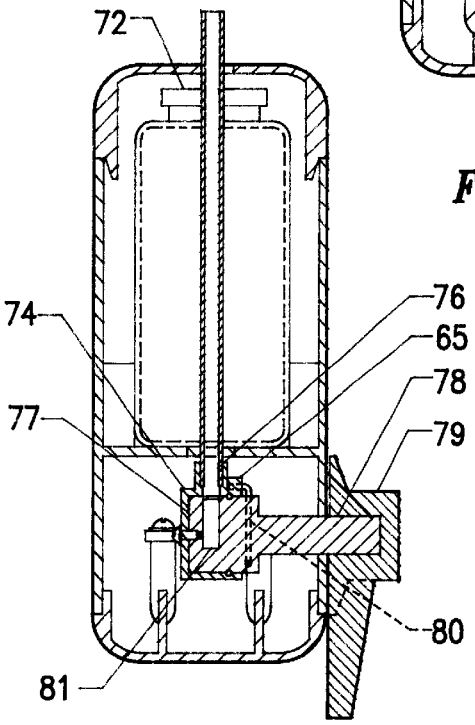
FIG. 12 is a cross-sectional view taken on the line 12—12 of FIG. 10.
Figure 14:
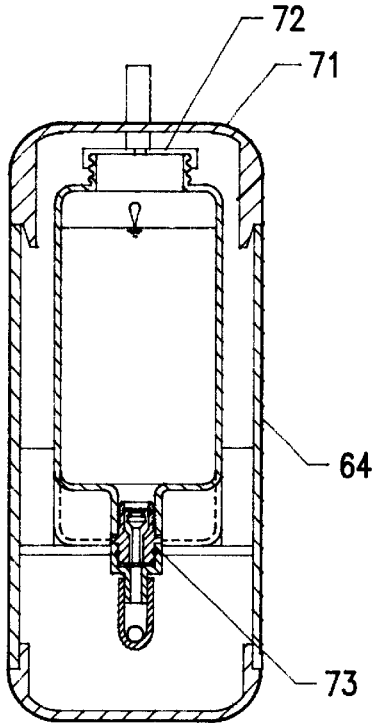
FIG. 14 is a cross-sectional view taken on the line 14—14 of FIG. 10.
Figure 19:
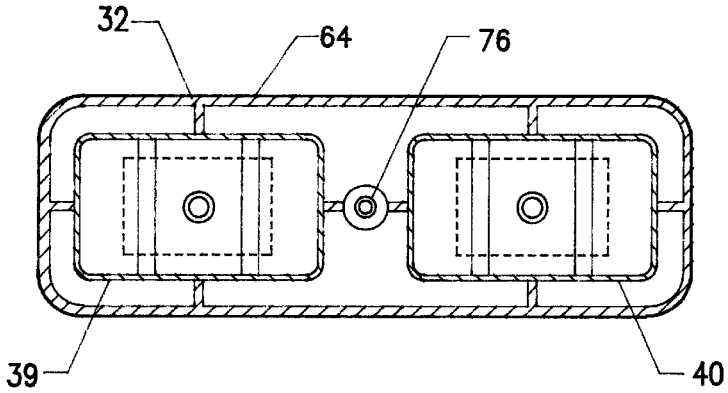
FIG. 19 is a cross-sectional view taken on the line 19—19 of FIG. 10.

In FIGS. 5 and 6 another embodiment 51 is illustrated wherein a liquid storage unit 52 is suspended from a wall bracket 53 and connected to a bathtub faucet 55. The venturi 54 is located within the liquid storage unit 52 and an inlet 56 of the venturi 54 is connected to the bathtub faucet 55 by a flexible tube 57. The venturi 54 withdraws a portion of a household liquid 38 from the storage unit 52 and discharges the liquid 38 which is mixed with water through a spray head 58. A flexible tube 59 and the spray head 58 are connected to an outlet 60 of the venturi 54 and discharge a mixture of the household liquid 38 and water through the spray head 58. In FIGS. 7 and 8 the liquid storage unit 52 of FIGS. 5 and 6 is connected to a faucet 61 of a laundry tub 62 or sink faucet with a hose coupling 63.

The design of the storage unit 32 is best understood by referring to FIGS. 9 through 19, inclusive. The storage unit 32 is a generally rectangular unit which comprises a housing 64, the pair of transparent containers 39, 40 and a control 65. The two containers 39, 40 are intended to be used for storing household products such as liquid soap and shampoo.

Figure 20:
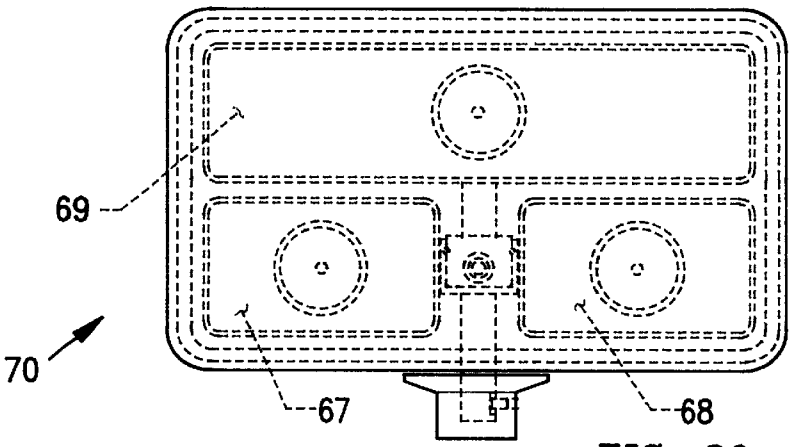
FIG. 20 is a plan view of an alternate embodiment of a liquid storage unit for our household liquid dispensing system.
Figure 21:
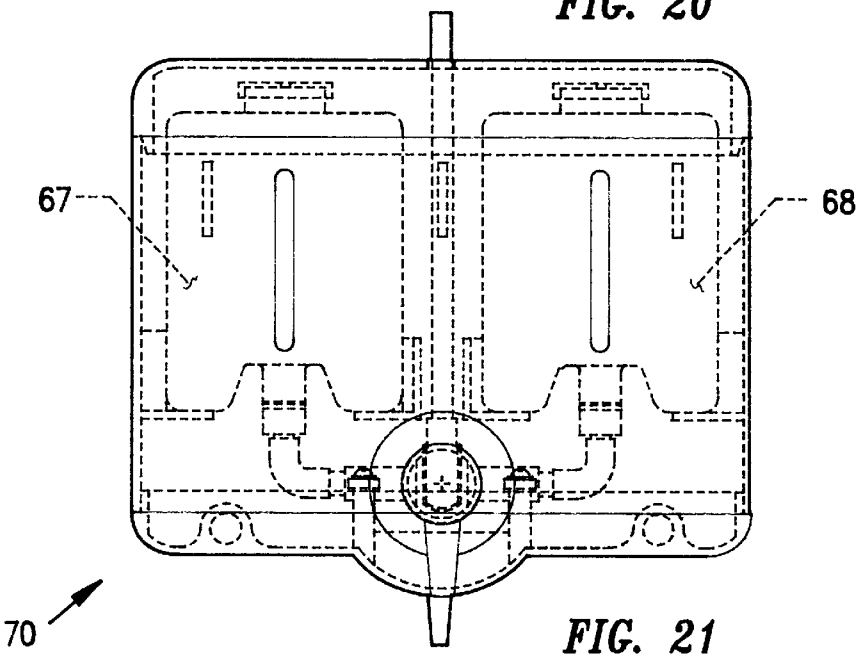
FIG. 21 is a front view of the liquid storage unit of FIG. 20.
Figure 22:
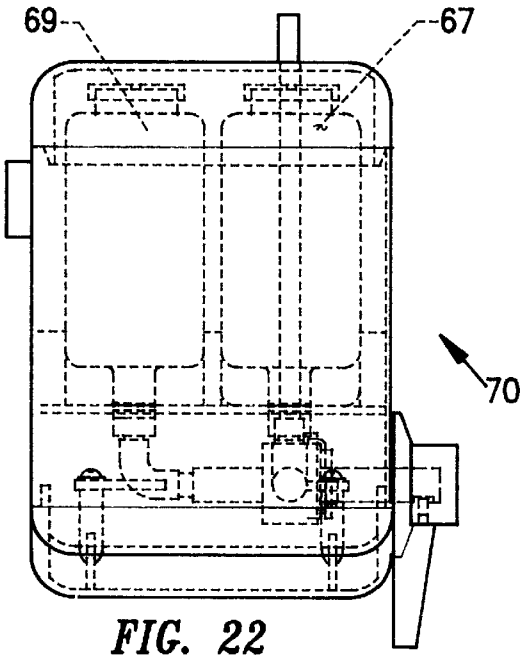
FIG. 22 is a right side view of the liquid storage unit of FIG. 20.

In the front of the housing 64 are a pair of narrow windows 66 for displaying the amounts of fluid 38 in the containers 39, 40. In FIGS. 20 through 22, inclusive, three containers 67, 68, 69 are provided in a fluid storage unit 70.

The top portion of the housing 64 is a removable cover 71 for filling the pair of containers 39, 40 with liquids 38. On a top portion of each of the containers 39, 40 is a vented cap 72 which is removed when adding a liquid 38. The liquids 38 in the containers 39, 40 flow through plunger type valves 73 in lower outlets 104 in the bottoms of the containers 39, 40 into the control 65. The plunger type valves 73 automatically close when the containers 39, 40 are withdrawn from the housing 64 for replacement or cleaning. The plunger valves 73 are an optional feature.

Figure 17:
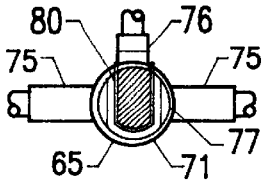
FIG. 17 is a cross-sectional view taken on the line 17—17 of FIG. 11.
Figure 18:
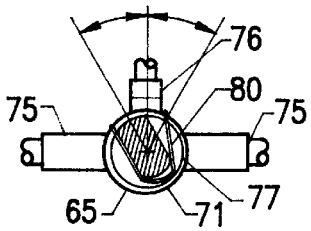
FIG. 18 is an alternate cross-sectional view taken on the line 17—17 of FIG. 11.

The construction of the rotary control 65 is illustrated in FIGS. 12, and 16 through 18, inclusive. The control 65 selects the fluids 38 and connects and disconnects the flow of fluids 38 from the storage unit 32 to the shower head 34. The control 65 includes a housing 74, having a pair of inlet ports 75 and a single outlet port 76. Inside of the housing 74 is a rotary valve 77. The rotary valve 77 has a horizontal shaft 78 portion which extends outwardly through an aperture of the housing 74. A knob 79 is mounted on the end of the shaft portion 78. With reference to FIGS. 17 and 18, a "U" shaped wire spring 80 biases the control 65 to a normally "off" position. In an outer portion of the valve 77 are stepped depressions 81 which direct fluid 38 from containers 39, 40 to the outlet port 76 when the valve 77 is rotated. The rate of fluid withdrawal varies with the amount of rotation of the valve 77.

Figure 1:
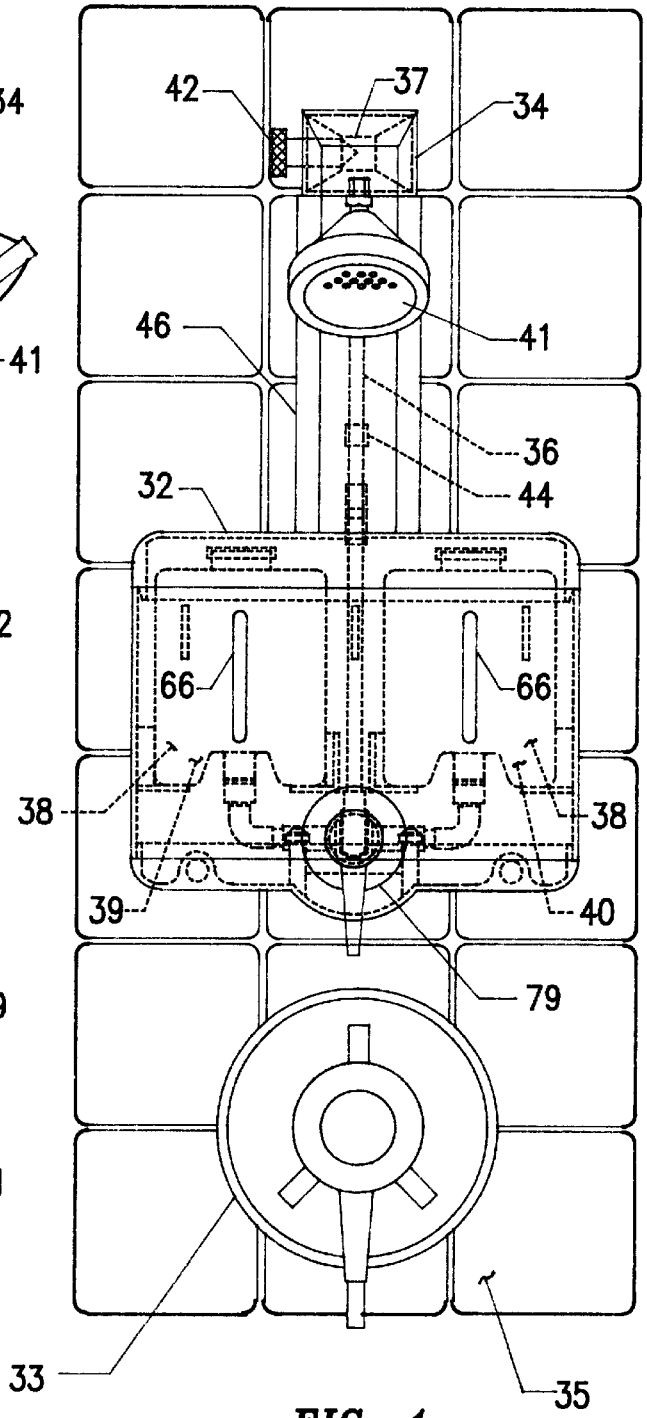
FIG. 1 is a front view of a liquid household dispensing system which embodies the present invention.
Figure 16:
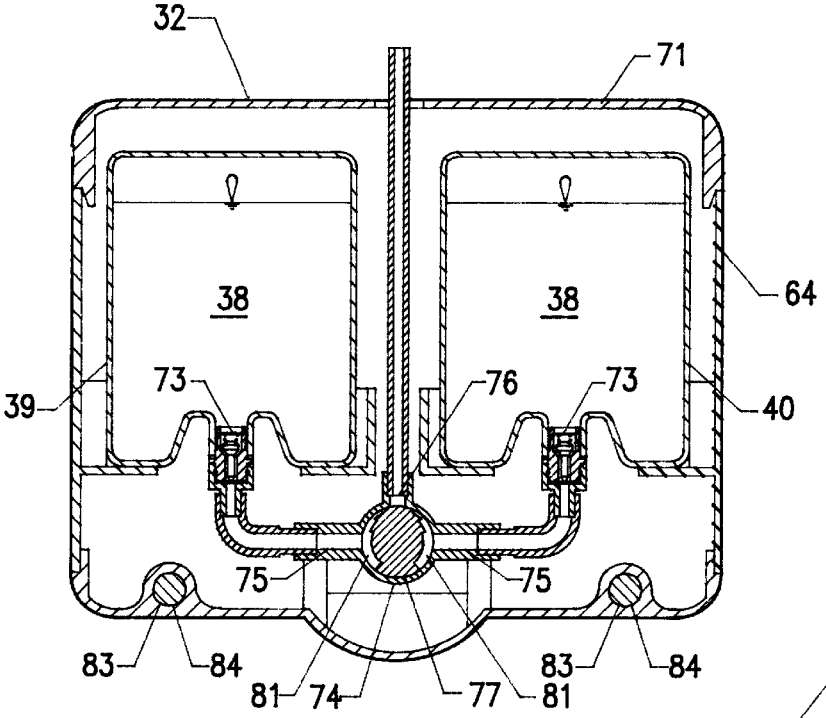
FIG. 16 is a cross-sectional view taken on the line 16—16 of FIG. 11.
Figure 15:
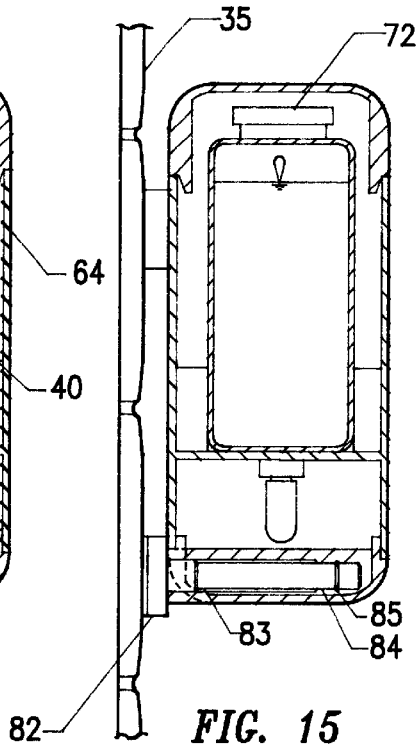
FIG. 15 is a cross-sectional view taken on the line 15—15 of FIG. 10.

In FIGS. 15 and 16, the means is shown for mounting the fluid storage unit 32 of FIGS. 1, 2 on the shower wall 35. A pair of slender horizontal cylindrical portions 83 of a bracket 82 which is adhesively attached to the shower wall 35 engage a pair of apertures 84 in the storage unit housing 64. An "O" ring 85 is mounted on an end portion of each of the cylindrical members 83to eliminate free play between the cylindrical members 83 and the apertures 84.

Figure 25:
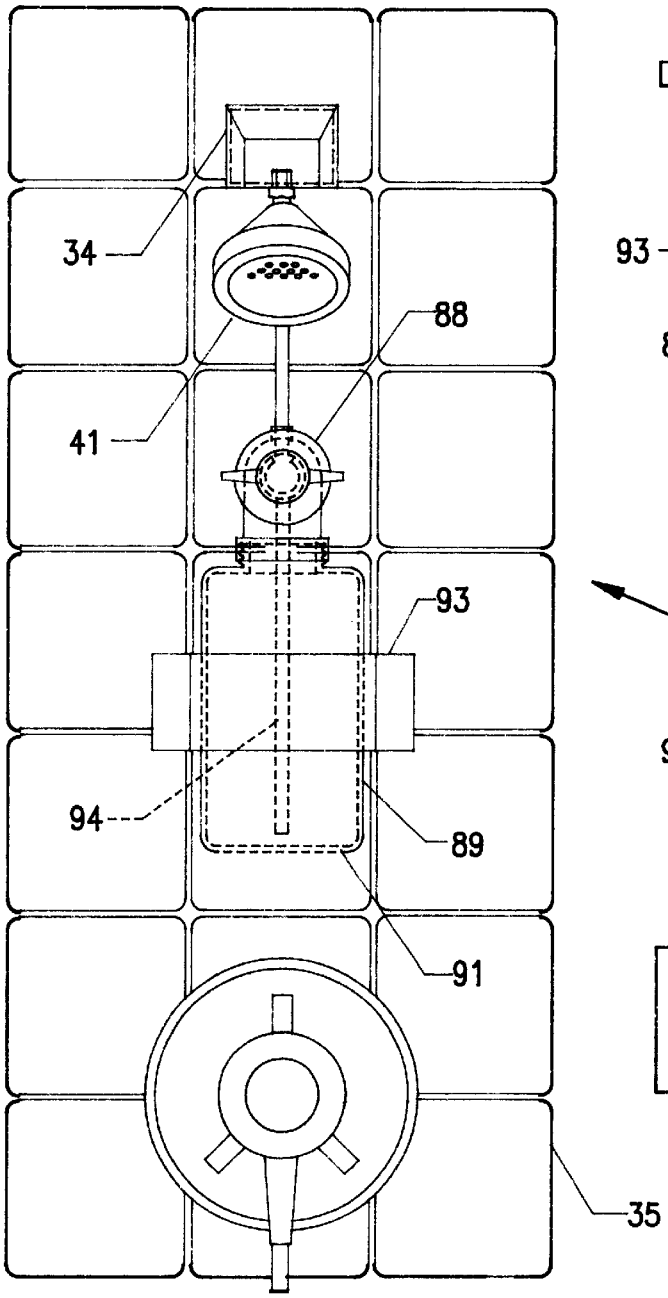
FIG. 25 is an alternate embodiment of a household liquid dispensing system having the liquid storage unit shown in FIGS. 23 and 24.
Figure 23:
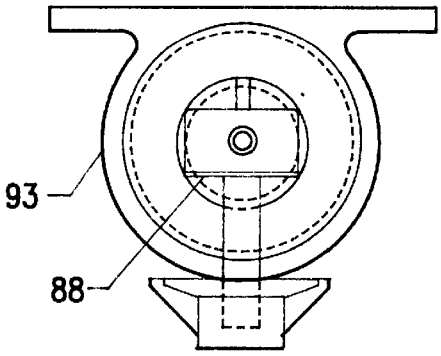
FIG. 23 is a plan view of a second alternate embodiment of a liquid storage unit for our household liquid dispensing system.
Figure 24:
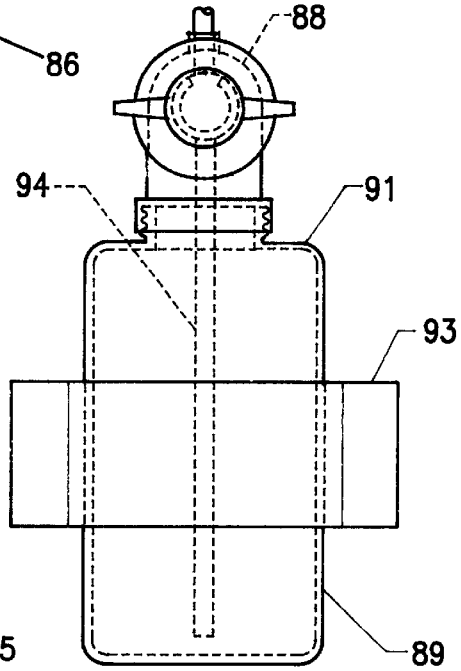
FIG. 24 is a front view of the liquid storage unit of FIG. 23.

Embodiments 86, 87 are shown in FIGS. 23 to 28 wherein rotary valves 88, 92 are located on top portions of fluid storage units 89, 90. In FIGS. 23 through 25, a fluid storage unit 89 consists of a single container 91 without an outer housing. The container 91 is suspended from the rotary valve 88 which is attached to the shower wall 35 with an adhesive or some other suitable means. A bracket 93 which is attached to the wall 35 provides further support for the container 91. The bottom of the container 91 extends through the bracket 93 to allow the container to be disconnected from the valve 88 by rotating the container 91. A pick-up tube 94 extends downwardly from the valve 88 for extracting fluid from the container 91.

Figure 28:
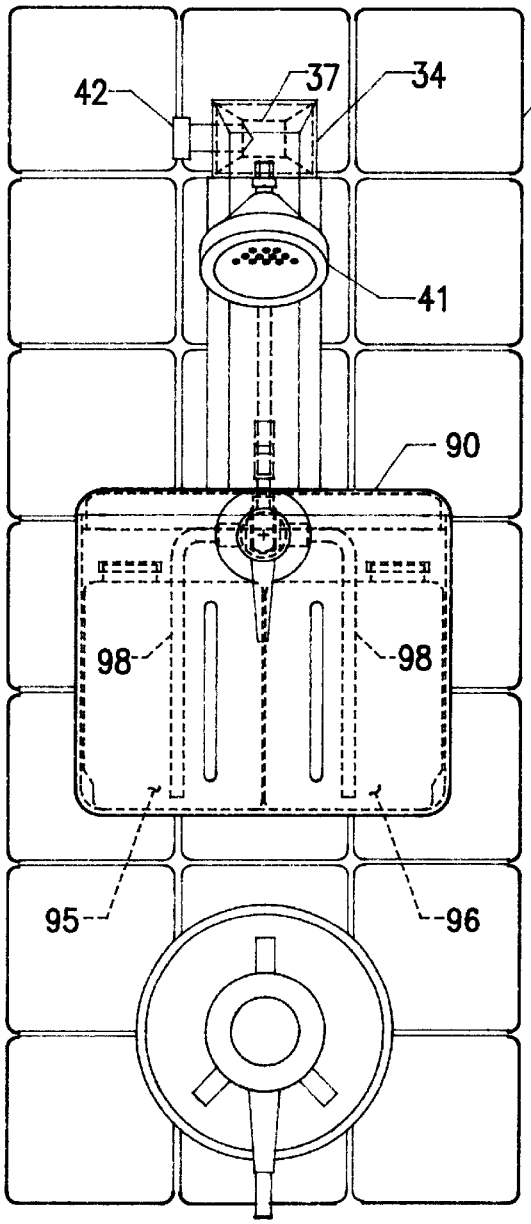
FIG. 28 is an alternate embodiment of a household liquid dispensing system having the liquid storage unit shown in FIGS. 26 and 27.
Figure 26:
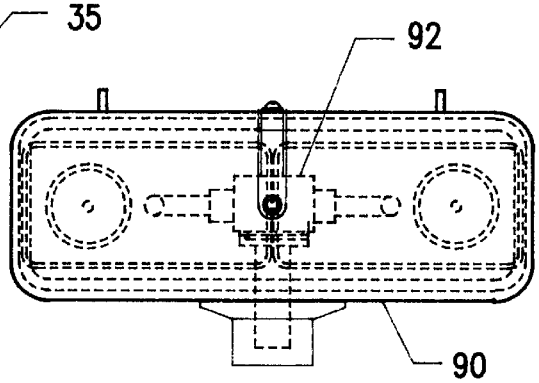
FIG. 26 is a plan view of a third alternate embodiment of a liquid storage unit for our household liquid dispensing system.
Figure 27:
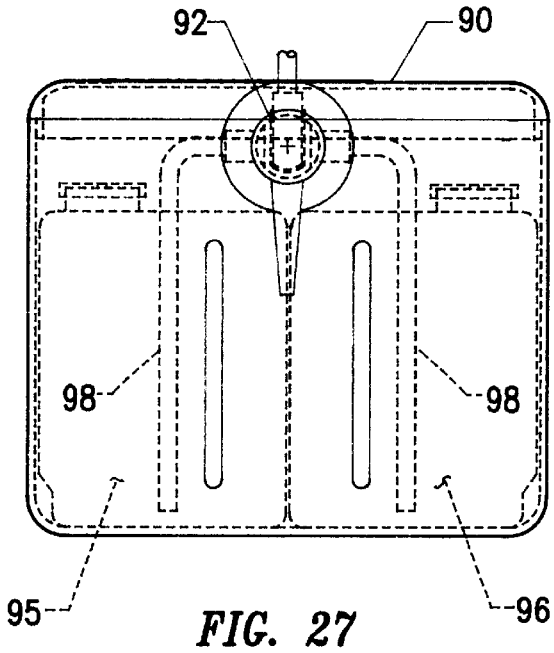
FIG. 27 is a front view of the liquid storage unit of FIG. 26.

In FIGS. 26 through 28, the fluid storage unit 90 has a pair of containers 95, 96 which are connected through the upper rotary valve 92 to the shower head 34. Fluids from the containers 95, 96 are drawn into the valve 92 by a venturi 37 through a pair of pick-up tubes 98 which extend downwardly into the containers 95, 96.

Figure 29:
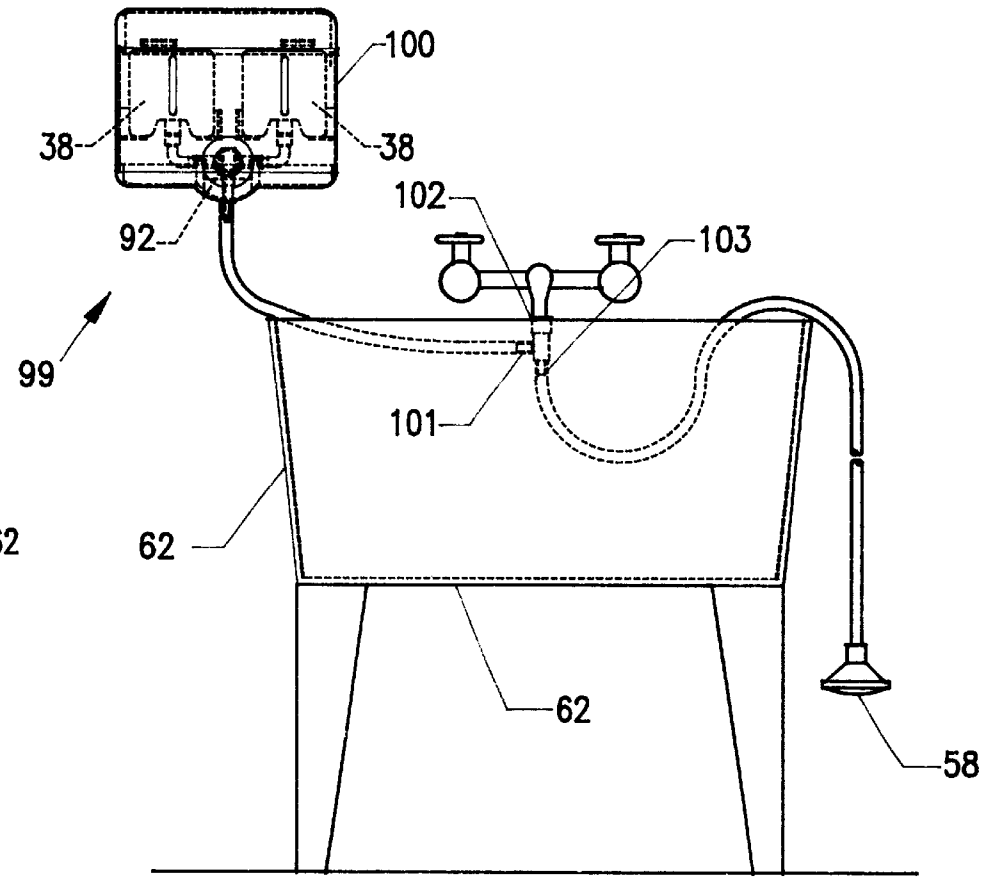
FIG. 29 is a front view of a second aspect of the invention.
Figure 30:
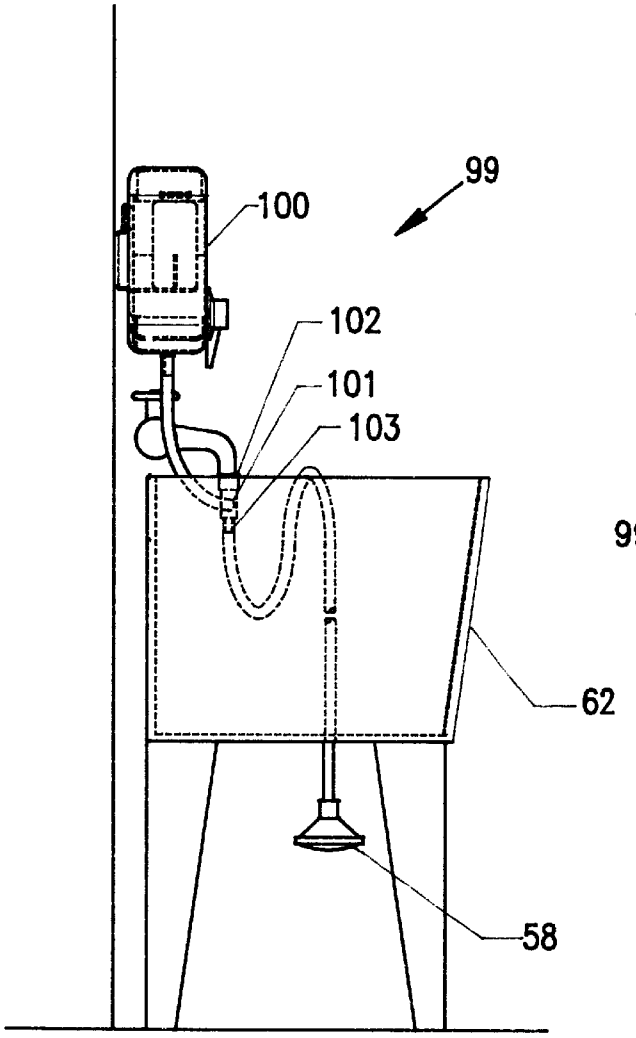
FIG. 30 is a right side view of FIG. 29.

A second aspect 99 of the invention is shown in FIGS. 29 and 30 which does not require a venturi. In this aspect, a fluid storage unit 100 is located above a laundry tub 62 and connected to an inlet port 101 of a hose coupling 102 and supplies a household fluid 38 by gravity feed when the control 92 is actuated. The fluid 38 combines with water in the hose fitting and is discharged through the spray head 58 which is connected to an outlet port 103 of the hose coupling 102.

From the foregoing it will be understood that our invention provides an improved means for controlling the use of fluids, such as soap, shampoo and dishwashing detergent in a household.

Although only several embodiments are illustrated and described, it is not our intention to limit the invention to these embodiments since other embodiments can be derived by such changes in shape, arrangement of parts and substitution of parts without departing from the spirit thereof.

What we claim as new is:

1. A dispensing system for discharging a mixture of water and a household liquid from an outlet of a showerhead, comprising: a household water system, said household water system having an outlet; a storage unit located below said outlet for storing at least one removable container; at least one removable container in storage unit for storing a household liquid, said container having a lower outlet for allowing a withdrawal of a portion of said liquid from said container and a valve for automatically closing said outlet when said container is removed from said storage unit; a household liquid such as soap, shampoo, or bath oil stored in said container; a means for withdrawing a portion of said household liquid from said container and adding said portion to said household water system; and a rotary resiliently biased control adjacent said lower outlet of said container for selecting said container and operatively connecting with and disconnecting said outlet of said container from said household water system, said control having a user manually open position where !said control is opened by said user and an automatically closed position where said control is automatically closed by said resilient bias when said control is released by said user.

2. The dispensing system recited in claim 1 wherein said means for withdrawing said portion of said household liquid stored in said container and adding said to said household water system is a venturi.

3. The dispensing system recited in claim 2 wherein said venturi is located in said household water system.

4. The dispensing system recited in claim 3 further comprising a needle valve for regulating the quantity of said household fluid when introduced into said household water system.

5. The dispensing system recited in claim 2 wherein said venturi is located in said storage unit.

6. The dispensing system recited in claim 1 wherein said control further regulates the amount of said household fluid which is introduced into said household water system.

7. The dispensing system recited in claim 1 wherein said household water system is a shower system.

8. The dispensing system recited in claim 1 wherein said storage unit has at least one pair of containers for storing a pair of liquids.

9. The dispensing system recited in claim 8 wherein said storage unit has three containers for storing three liquids.

10. The dispensing system of claim 1 wherein a shelf is mounted on a wall of a shower enclosure to support said storage unit.

11. A dispensing system for discharging a liquid household product such as a soap, shampoo, bath oil and dishwashing detergent through an outlet of a household water system, such as a shower, bath tub, laundry tub or sink, comprising: a household water system, said household water system having an outlet; a storage unit for storing at least one liquid; a household liquid stored in said storage unit; a means for introducing a portion of said household liquid into said household water system; a means for operatively connecting said storage unit to said household water system and a means for mounting said storage unit, said means having a bracket, said bracket having a pair of slender outward extending cylindrical portions, a pair of apertures in said storage unit for receiving said outward extending portions of said bracket, and a means for adhesively attaching said bracket to a shower wall.

* * * * *

UNITED STATES PATENT AND TRADEMARK OFFICE

CERTIFICATE OF CORRECTION

PATENT NO. : 6,421,847 B1 
DATED : July 23, 2002
INVENTOR(S) : Joseph J. Berke and Charles T. Michael It is certified that error appears in the above-identified patent and that said Letters Patent is hereby corrected as shown below:

Column 1,
Line 16, change "currently" to -- Currently --
Line 45, change "one" to -- One --

Column 3,
Line 32, change "cover 48" to -- cover 43 --

Column 5,
Line 28, after "adding said" insert -- portion --

Signed and Sealed this

Third Day of September, 2002

*Attest:*

*Attesting Officer*

JAMES E. ROGAN
*Director of the United States Patent and Trademark Office*